United States Patent [19]

Orozco Rodriguez et al.

[11] 4,255,204

[45] Mar. 10, 1981

[54] PROCESS FOR INHIBITING THE DETERIORATION OF CANE SUGAR

[76] Inventors: Leoncio R. O. Rodriguez, Calle 27 #559 Apt. 1, Vedado, Ciudad de la Habana; Jose A. U. Herrera, Goicuria #157 altos entre Libertad y E. Palma, Stos Suarez, C. de la Habana; Eduardo R. Suarez, Calle 80 #8503, Güira de Melena, Habana, all of Cuba

[21] Appl. No.: 6,120

[22] Filed: Jan. 24, 1979

[51] Int. Cl.[3] ..... C13B 3/00

[52] U.S. Cl. ..... 127/46 R

[58] Field of Search ..... 127/46 R, 50, 42

[56] References Cited

U.S. PATENT DOCUMENTS 2,093,759 9/1937 Hartmann ..... 127/46 R

*Primary Examiner*—William F. Smith

*Attorney, Agent, or Firm*—Haseltine and Lake

[57] ABSTRACT

Can sugar syrup is heated in an alkaline medium at a constant pH, e.g. 7 to 10, for a period of time e.g. 1–5 hours, to reduce the amino acid content of the syrup and to increase the buffer action so that deterioration is delayed by stabilization of the syrup pH at substantially neutrality.

2 Claims, 2 Drawing Figures

PROCESS FOR INHIBITING THE DETERIORATION OF CANE SUGAR

This invention relates to the manufacturing of raw cane sugar and to methods for treating its intermediate products in order to produce sugars and final molasses which will be more stable during storage.

Analogous solutions which have been put forward to inhibit deterioration are all based on increasing the pH of the products, as pointed out in the case of sugar by B. Costis-Jones, B. P. No. 1200605 and in the case of molasses by N. Taygun, Seker Vol. 17 (1968) No. 65, p. 1-5; M. Friml, Listy Cukrovarnicke, 87:11 (1971), 43.

These works are the prototypes most closely related to our invention.

According to out studies on sugar product deterioration, we have noted that this process is divided into two stages. A first stage, which shall be called induction period, where there is observed: the consumption of amino acids by reaction with reducing sugars, a major pH decrease and the accumulation of reducing sugars by inversion of sucrose. The second stage, known as intense deterioration period, where a violent degradation of reducing sugars takes place accompanied by a rapid formation of polymeric colored substances.

Up to the present, the solutions proposed for delaying deterioration are based on the extension of the induction period by delaying the sucrose inversion process as a result of increasing the product's initial pH. These methods, however, do not eliminate the basic cause of the initial pH decrease, which is the disappearance of amino acids from the medium by their reaction with reducing sugars, thus bringing about products which are more acid than reducing sugars.

It is for this reason that the delay attained is a short one.

Due to the above, our procedure is aimed at extending the delaying of the deterioration process by the removal of the highest rate of amino acids and an increase of the buffer action of the system.

In order to attain this objective, we take advantage of the higher velocity of the Maillard reaction (between amino acids and reducing sugars) in an alkaline medium for the building up of Amadori-type products (ketoamino acids and aldoamino acids) and for the rapid formation of organic acids, as a result of the alkaline degradation of reducing sugars.

Hence, after heating in an alkaline medium at a constant pH for a period of 1-5 hours (depending on the syrup involved), we obtain a product with a lower amino acid content (which is the cause of the initial pH drop at the beginning of deterioration) and with a high buffer action, due to its higher organic acid content.

Therefore, a product thus treated will keep a stable pH near neutrality, which will delay deterioration during storage.

In the course of the sugar manufacturing process, the product best suited for the application of this treatment is syrup, since in more diluted products, the reaction rate between sugars and amino acids is considerably lower.

In view of the above, we may state that our invention consists essentially of reducing the amino acid content and increasing the buffer action of syrups by heating them in an alkaline medium for a period of time of 1-5 hours (depending on the syrups). This treatment ensures higher stability of syrups and syrup products (raw sugar and final molasses) against deterioration.

Figure 1:
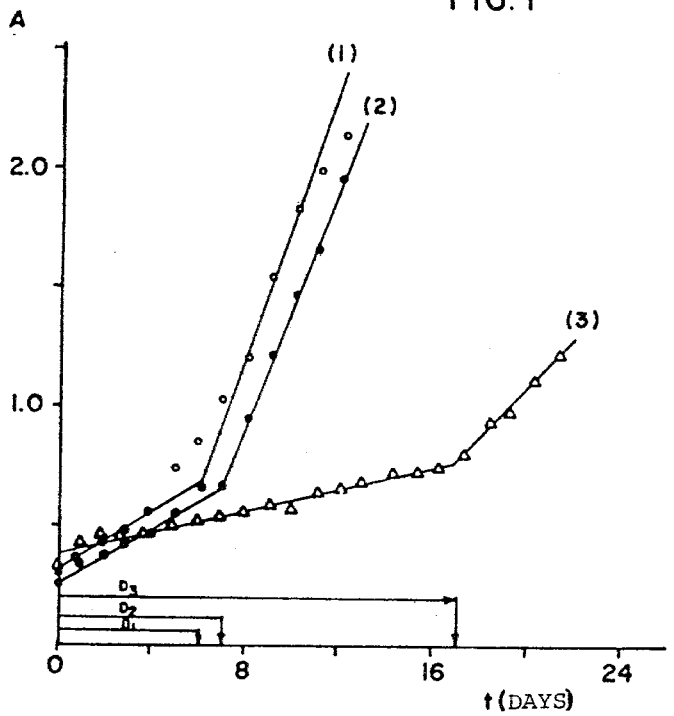
FIG. 1 is a graph showing the relationship between color formation and heating time.

In syrup under different conditions color formation A (as determined on an aqueous solution at 11 pH and 420 nm wave length) is shown in FIG. 1 plotted against heating time in days at 80° C., at reflux.

1. untreated syrup
2. • limited syrup
3. Δ treated syrup

After it has been processed as mentioned above, the syrup is heated to 80° C. at reflux, so as to simulate the deterioration process that occurs during the storage of sugar products.

Induction period D (time required —indicated by an arrow—before the intense deterioration period takes place) is longer in syrups treated by our procedure than in the case of syrups whose pH is only increased with respect to an untreated syrup. (See FIG. 1).

The need to reduce the amino acid concentration and to increase the buffer action of the system in order to actually extend the induction period is illustrated by the above.

Figure 2:
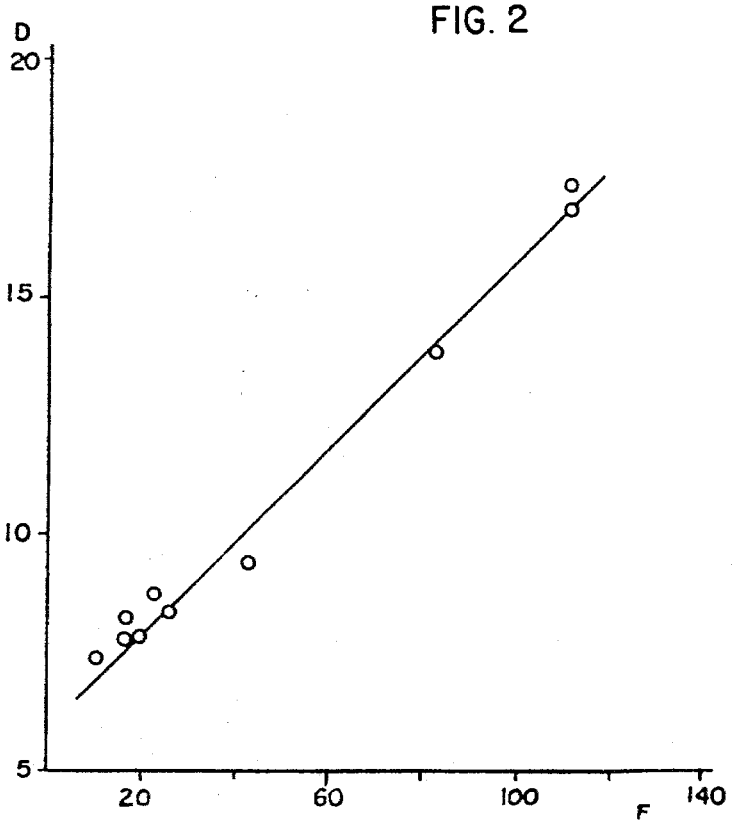
FIG. 2 is a graph showing the relationship between the induction period and the F value (buffer action quotient).

FIG. 2 shows the D of a syrup treated by different ways against the value of the buffer action quotient and amino acid concentration. As may be seen, there is a linear relationship between the time at which a syrup begins to deteriorate and this quotient called F. Knowing the F value, the susceptibility of the product to deterioration and the treatment most suitable to attain its stability against deterioration for a given time may also be known.

The variation of the different parameters of the system resulting from treatment and the delaying effect that may be obtained for untreated limed syrups are shown in the Table.

As may be seen from this table, no detectable sucrose losses occur during the treatment and there is a 10-30% consumption in the concentration of reducing sugars which are transformed into organic acids, thus increasing the buffer action of the system. A 30-80% reduction in the amino acid concentration also takes place.

In this way, as has already been stated, product deterioration is significantly decreased by the lengthening of its induction period.

Parameters for an adequate treatment of syrup directed to produce minimum reducer losses and NaOH consumption depend on syrup quality and on the length of the period during which products manufactured from such a syrup are stored.

A heater for increasing syrup temperature to a range of 70°-100° C. and a potentiostat provided with a suitable stirring system to ensure a constant pH from 7 to 10 are required for the treatment. The syrup is heated ad limed to a given temperature and pH, whereupon it should be treated for a period of up to 5 hours, depending on the variation of amino acid concentration and buffer action desired.

This procedure guarantees, by means of parameter F, an adequate control of sugar products, according to storage time, and conditions. This ensures storage with no risks of sucrose losses or high color formation.

When storing sugars for more than three months under normal storaging conditions, product deterioration is very likely to occur, which sometimes makes it necessary to reprocess at high sucrose losses in molasses which increase losses produced during storage.

Solutions proposed up to the present do no enable an adequate control of product quality and do not guarantee product stability during long storaging periods.

Therefore, our invention is more suitable from an economical point of view, since the higher treatment costs are justified by a better control of deterioration, the guarantee of a longer storaging period and the avoidance of high sugar losses.

TABLE

| Measured parameters | Variation during treatment |
|---|---|
| Sucrose | Non detectable by the E. Lane method |
| Reducers | −(10–30)% |
| Amino acids | −(30–80)% |
| Color | −(1–5)% |
| NaOH consumption by kg of syrup | 3–8 g |
| D | 8–13 days with respect to untreated and limed syrups |
| Buffer action | 6–9 |

We claim:

1. A process for inhibiting the deterioration of cane sugar products during storage comprising heating a cane sugar syrup at a temperature of from 70° to 100° C. in an alkaline medium at a pH of from 7 to 10 for a period of time sufficient to reduce the amino acid content of the syrup 30 to 80% and to increase the buffer action by transforming reducing sugars to organic acids so that deterioration is delayed by stabilization of the syrup pH at substantial neutrality.

2. The process of claim 1 wherein the syrup is heated for a peroid of time of up to 5 hours.

* * * * *